US006612819B1

(12) United States Patent
Furst et al.

(10) Patent No.: US 6,612,819 B1
(45) Date of Patent: Sep. 2, 2003

(54) PUMPING DEVICE

(75) Inventors: Stefan Furst, Kronberg (DE); Werner Haczek, Idstein (DE); Andreas Peter, Kronberg (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/931,114

(22) Filed: Aug. 16, 2001

Related U.S. Application Data

(63) Continuation of application No. PCT/EP99/08522, filed on Nov. 6, 1999.

(30) Foreign Application Priority Data

Feb. 19, 1999 (DE) ..... 199 07 222

(51) Int. Cl.[7] ..... F04B 43/00
(52) U.S. Cl. ..... 417/479; 417/571
(58) Field of Search ..... 417/53, 479, 571; 606/172; 30/41; 117/104; 128/66

(56) References Cited

U.S. PATENT DOCUMENTS 2,754,228 A * 7/1956 Bede ..... 117/104
3,645,651 A 2/1972 Bills
3,910,266 A * 10/1975 Kawase ..... 128/66
4,228,587 A * 10/1980 Bennett ..... 30/41
4,480,387 A * 11/1984 Costemore d'Arc ..... 30/41
5,098,262 A * 3/1992 Wecker et al. ..... 417/479
5,586,868 A * 12/1996 Lawless et al. ..... 417/53
5,653,025 A * 8/1997 Cheng et al. ..... 30/41
5,993,180 A * 11/1999 Westerhof et al. ..... 417/571
6,126,669 A * 10/2000 Rijken et al. ..... 606/172

FOREIGN PATENT DOCUMENTS

| | | |
|---|---|---|
| FR | 2 382 319 | 9/1978 |
| FR | 2 613 975 | 10/1988 |
| WO | WO 98/08661 | 3/1998 |

* cited by examiner

*Primary Examiner*—Teresa Walberg
*Assistant Examiner*—Leonid Fastovsky
(74) *Attorney, Agent, or Firm*—Fish & Richardson PC

(57) ABSTRACT

A pumping device for drawing in and delivering a liquid to a liquid dispensing device of a hair removing apparatus the pumping device includes a pump inlet and a pump outlet and a pumping element. The pumping device is formed by a first and a second housing part each having integrally formed therein a first and a second flow channel. The pumping device includes a membrane member disposed between the first and the second housing part the membrane member includes a pumping element and at least one valve element. The pump inlet is adapted to be coupled to a liquid dispensing device and the pump outlet to a liquid container.

21 Claims, 7 Drawing Sheets

PUMPING DEVICE

This is a continuation of PCT application Ser. No. PCT/EP99/08522, filed Nov. 6, 1999.

BACKGROUND

This invention relates to a pumping device for drawing in and delivering a liquid as, for example, a shaving aid, to a liquid dispensing device of a hair removing apparatus as, for example, a dry shaving apparatus, a hair clipping machine, or an epilation appliance, with a pump inlet, a pump outlet and a pumping element.

A pumping device for drawing in a lotion and dispensing it to the shaving head of a dry shaving apparatus is known from PCT WO 98/08661. The pump is comprised of a total of four components, including a housing part having a pump inlet and a pump outlet and integral flow channels, a membrane disk with nonreturn valves, a control disk, and a pumping element which is constructed from a membrane and designed to be actuated indirectly or directly by hand. It is an object of the present invention to simplify the pumping device of the type initially referred to, in particular to reduce the number of components. The pumping device should also be suitable for high pumping frequencies, i.e., for operation with an electric drive.

SUMMARY OF THE INVENTION

According to the invention this object is accomplished in a pumping device of the type initially referred to, wherein the pumping device is formed by a first and a second housing part having integrally formed therein flow channels as well as valve chambers and a membrane member disposed between the first and the second housing part and including a pumping element and at least one valve element, and that the pump inlet is adapted to be coupled to a liquid dispensing device and the pump outlet to a liquid container.

The pumping device of the invention has a plurality of advantages. One major advantage of the invention is that the pumping device is constructed from only three components. This results in a considerable saving of production costs.

According to one embodiment of the invention the pumping device is disposed outside a liquid container. According to a preferred embodiment of the invention the pumping device is disposed inside the liquid container.

A considerable saving of production costs results from one wall of a liquid container being constructed as a first housing part of the pumping device. The two other components, namely the membrane and the second housing part, are associated with this wall and secured to it. In a further aspect of the previously mentioned embodiment the membrane member arranged between the first housing part and the second housing part is of elastic construction.

A preferred embodiment of the invention is characterized in that the valve element and the pumping element are of elastic construction and provided as part of the membrane member. In a further aspect of the invention provision is made for the flow channel leading from a pump inlet to a pump outlet to be formed by a pump chamber and a first valve chamber and a second valve chamber.

An essential advantage of the invention results by designing the pumping device with the liquid container to be replaceable. Hence the efficiency of the pumping device is designed only for the quantity of liquid to be dispensed from the liquid container. The quality requirements to be imposed on the pumping device are therefore extremely low and result accordingly in an extremely economical production of the pumping device and the liquid container.

One embodiment of the present invention is illustrated in the accompanying drawings and will be described in more detail in the following.

DETAILED DESCRIPTION

Figure 1:
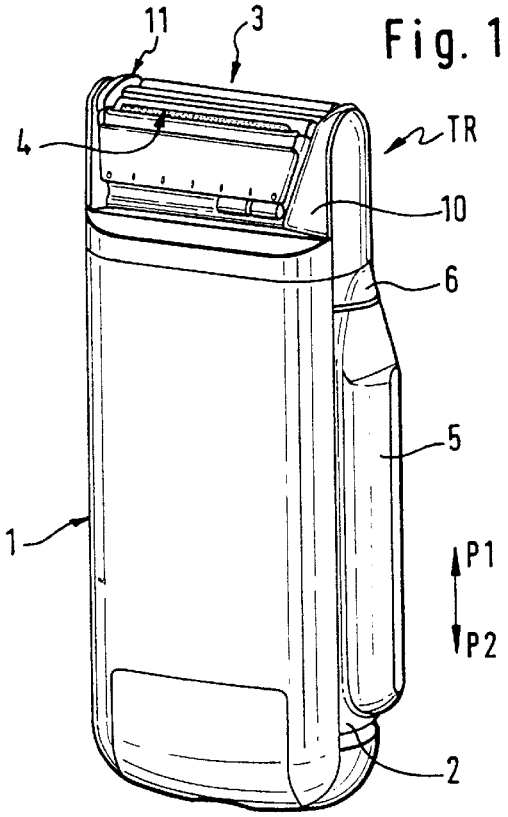
FIG. 1 is a perspective view of a dry shaving apparatus, showing the rear of the apparatus and a liquid container attached to one narrow side.

FIG. 1 shows a perspective representation of a dry shaving apparatus TR with a view of the rear of the housing 1 and of one of the two narrow sides 2 of the housing 1, and of the shaving head 3 on which a liquid dispensing device 4 is provided. A liquid container 5 is adjustably arranged on the narrow side 2 of the housing 1. In FIG. 1 the liquid container 5 is in abutment with a stop 6 provided on the housing 1. This liquid container 5 may also be disposed inside the housing 1—not illustrated.

Figure 2:
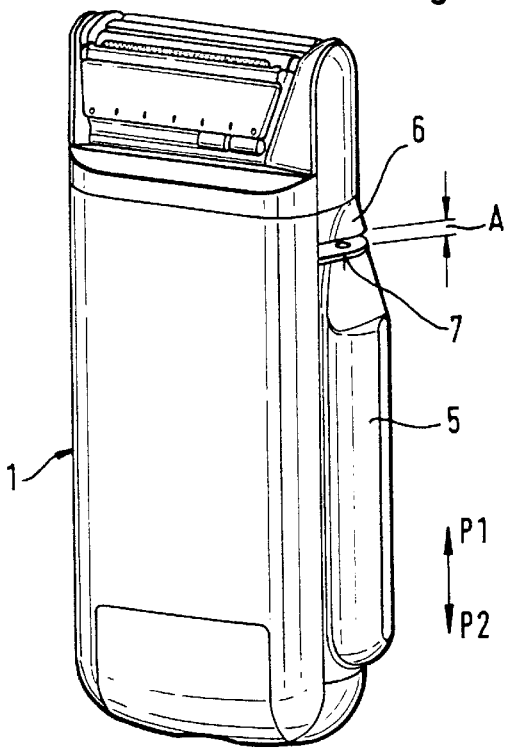
FIG. 2 is a view of the dry shaving apparatus of FIG. 1, showing a liquid container spaced from a stop by a distance A.

FIG. 2 shows the dry shaving apparatus of FIG. 1, the difference being that a distance A is produced between the upper wall 7 of the liquid container 5 and the stop 6 by sliding the liquid container 5 in the direction of the arrow P2. Sliding the liquid container 5 in the directions of the arrows P1 or P2 results in either the coupling or uncoupling of a pumping device 13 adapted to be driven by an electric drive 50 of the dry shaving apparatus—see FIG. 9.

Figure 3:
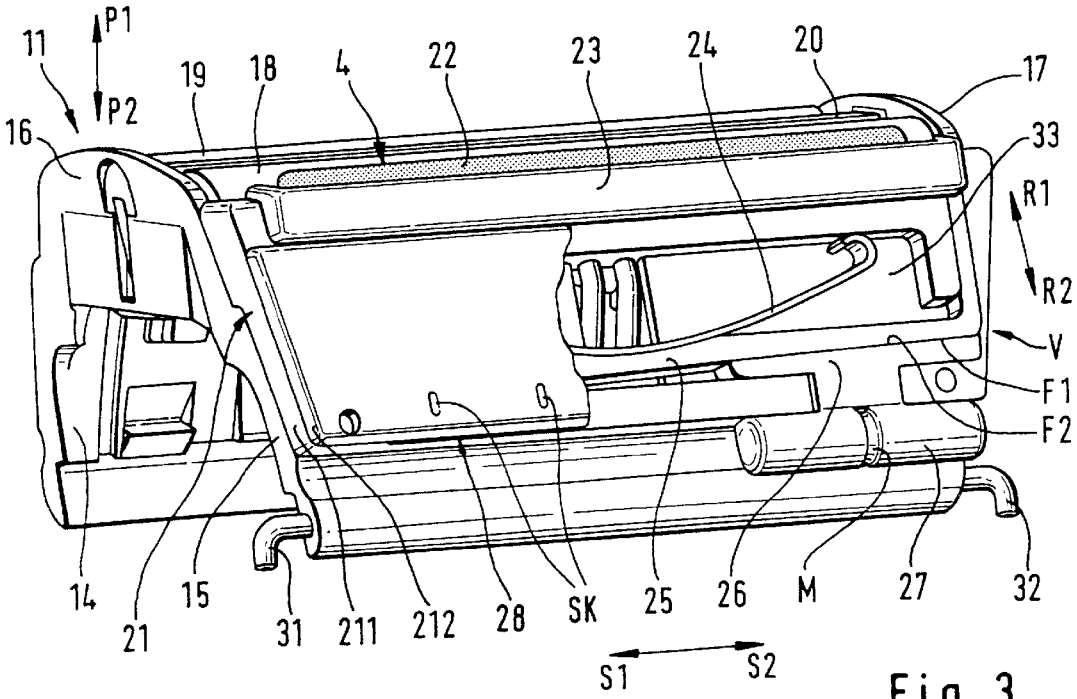
FIG. 3 is a view of a cutter frame with a housing whose outer housing part is shown only in part to expose the interior of the housing.

The shaving head 3 has at least one outer cutter and one undercutter cooperating therewith, as well as a shaving head frame 10 and a cutter frame 11 configured to be removed therefrom. One embodiment of such a cutter frame 11 is presented in FIGS. 3, 4 and 5 and will be explained in more detail in the following.

Figure 4:
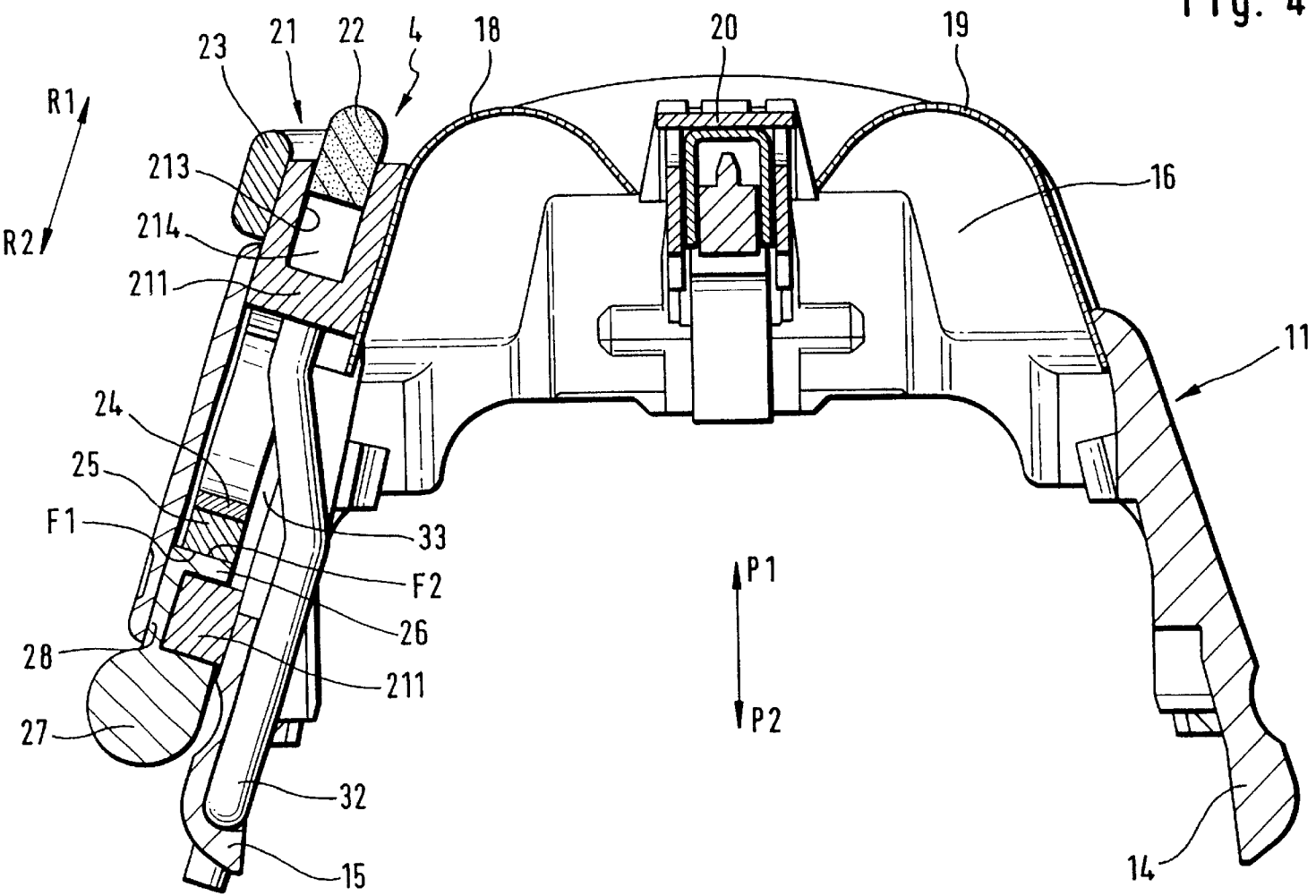
FIG. 4 is a sectional view of the cutter frame 11 and the liquid dispensing device.
Figure 5:
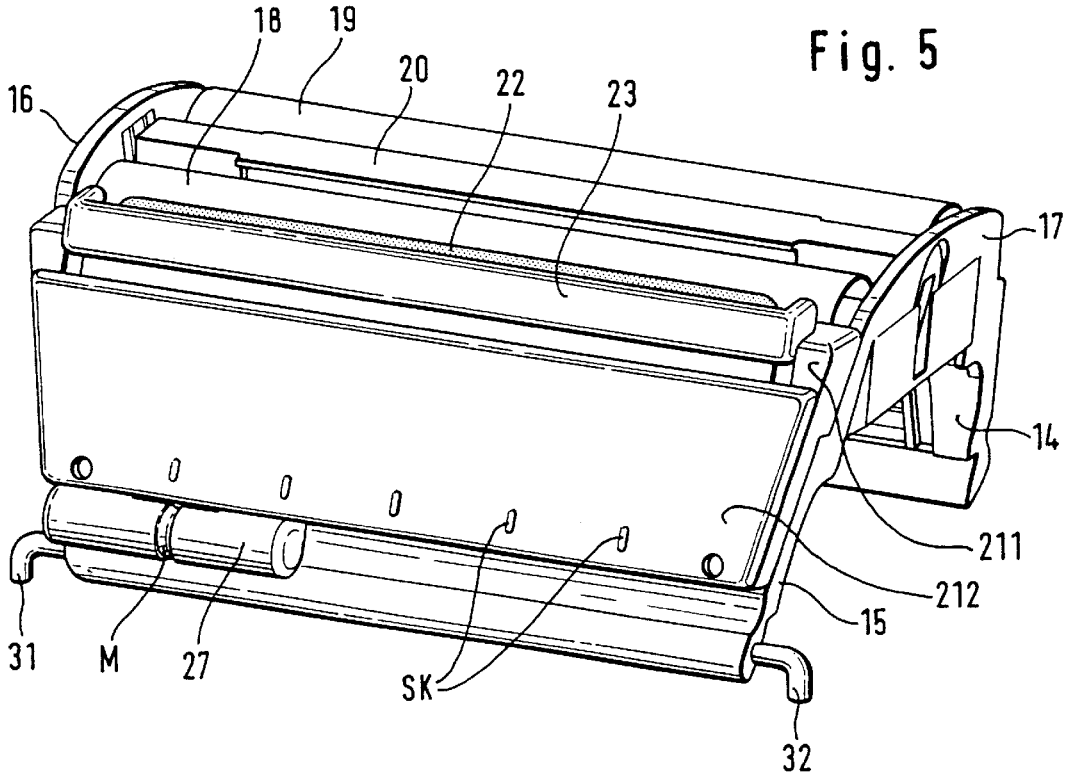
FIGS. 5 and 6 are perspective views of the cutter frame with a liquid dispensing device and an actuating element occupying different positions.
Figure 6:
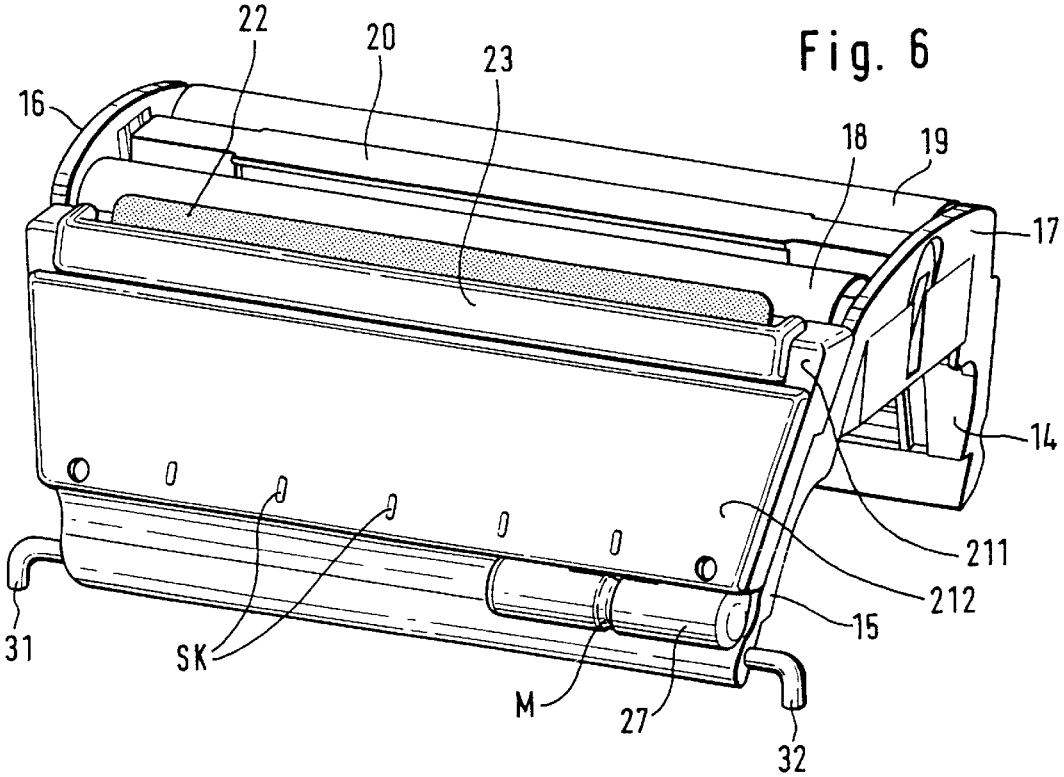

Inside the cutter frame 11—see also FIG. 4, FIG. 5 and FIG. 6—the outer cutters 18, 19, attached in arched form, of the short-hair cutter units are secured to longitudinally extending side walls 14 and 15 as well as to bars—not shown—disposed between end walls 16 and 17. The longhair cutter unit with a U-shaped outer cutter 20 disposed between the two outer cutters 18 and 19 of the short-hair cutter units is mounted in the end walls 16 and 17 of the cutter frame 11 so that it can move in vertical direction—in the directions of the arrows P1 and P2.

A liquid dispensing device 4 is provided on one side wall 15 of the cutter frame 11. The liquid dispensing device 4 is essentially comprised of a housing 21 made up of two housing parts 211 and 212, an open-pore contact element 22 disposed in the housing 21, a spacer 23 associated with the contact element 22, and an adjusting device V by means of which the spacer 23 can be moved to and fro in the directions of the arrows R1 and R2. The adjusting device V is comprised of two cooperating adjusting elements 25 and 26 having surfaces F1 and F2 arranged at a relative inclination, a spring element 24, and an actuating element 27. Movably arranged in an inner compartment 33 of the housing part 211 of the housing 21 are the adjusting element 26 fitted with the actuating element 27, and the adjusting element 25 provided on the spacer 23. The spring element 24 rests with one part against a wall of the inner compartment of the housing part 211 and with another part against the adjusting element 25, its predetermined spring pressure operating to maintain the incline surface F1 in abutment with the inclined surface F2 of the adjusting element 26. The housing part 212 of the housing 21 is fastened to the housing part 211, acting as a cover for the inner compartment 33 of the housing part 211.

The actuating element 27 with a marking M is provided on the adjusting element 26, which is slidably mounted inside the housing 21 and projects out of the housing 21 through an elongate opening 28. The actuating element 27 with the marking M is slidable parallel to a scale SK provided on an outer wall of the housing part 212. When the actuating element 27 is moved in the direction of the arrow S1, the inclined surface F2 of the adjusting element 26 cooperates with the inclined surface F1 of the adjusting element 25 to move the spacer 23 in the direction of the arrow R1. The spacer 23 is returned to its initial position —in the direction of the arrow R2—by sliding the actuating element 27 in the opposite direction—direction of the arrow S2.

The open-pore contact element 22, which is equipped with a rinsing chamber 214, is fixedly arranged in an inner compartment 213 of the housing part 211. The housing part 211 is arranged adjacent and parallel to the longitudinal dimension of the outer cutter 18 in such a way that the contact element 22, which is arranged in the inner compartment 213 and partly projects out of the inner compartment 213, is in a position to dispense liquid to a zone adjacent to the outer cutter 18. The contact surface of the contact element 22 used at any one time is variable and the liquid dispensing rate thus controllable by adjusting the spacer 23 relative to the contact element 22—see FIGS. 5 and 6.

The liquid to be dispensed by the contact element 22 of the liquid dispensing device is fed to the contact element 22 via a second liquid conduit 32. Metered application of the liquid by the contact element 22 is also controllable by drawing liquid from the liquid dispensing device 4 via a first liquid conduit 31.

Figure 7:
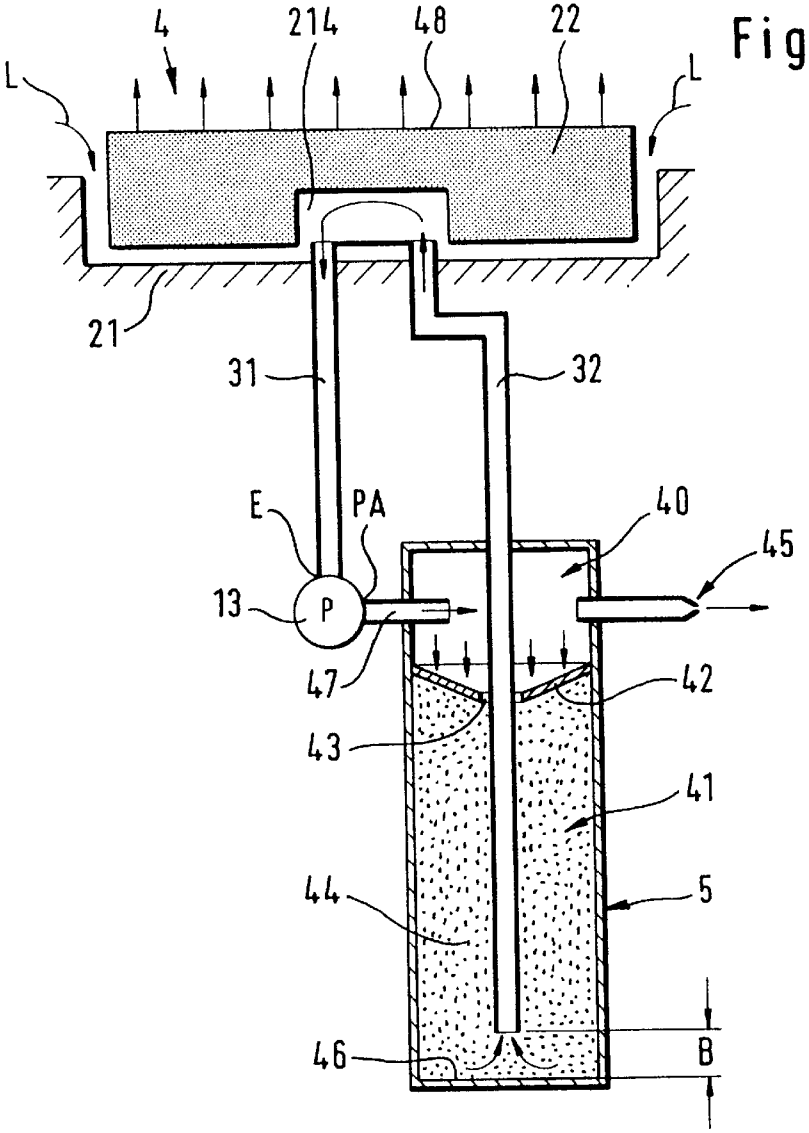

FIG. 7 shows a schematic representation of an arrangement for conveying liquid from the liquid container 5 to the liquid dispensing device 4 and from the liquid dispensing device 4 back into the liquid container 5. A partition wall 42 is provided in the liquid container 5 to form a first chamber 40 and a second chamber 41. An opening is provided in the partition wall 42. A second liquid conduit 32 is passed through this opening and terminates at a predetermined distance B from the bottom 46 of the liquid container 5. The opening in the partition wall 42 is dimensioned so that a gap 43 is formed after the second liquid conduit 32 is passed through. This gap serves the function of feeding liquid from the first chamber 40 into the second chamber 41. A porous storage material 44—e.g., a sintered material—is provided in the second chamber 41 to store the liquid. The first chamber 40 is connected by a liquid conduit 47 to a pumping device 13 provided outside the liquid container 5. The necessary pressure for conveying liquid from the second chamber 41 via the second liquid conduit 32, which acts as a riser, to the liquid dispensing device 4 is obtainable by means of a pressure relief valve 45 when the liquid conveying arrangement is working. The pressure relief valve 45 may be comprised of a tube, for example, having an orifice whose cross section is dimensioned to enable the necessary atmospheric pressure for conveying the liquid to be reached after the pumping device 13 is started and to enable any excess pressure to be discharged.

A contact element 22 is fixedly arranged in the housing 21 of the liquid dispensing device 4. By suitably shaping the contact element 22 a rinsing chamber 214 is provided in the contact element 22 which receives liquid via the second liquid conduit 32. The liquid under pressure penetrates the open-pore material of the contact element 22 and, when the outer contact surface 48 is touched by the skin, is dispensed onto the skin as indicated by the arrows.

The rinsing chamber 214 is coupled by a first liquid conduit 31 to the inlet side E of the pumping device 13. The outlet side PA of the pumping device 13 is coupled by a liquid conduit 47 to the first chamber 40 of the liquid container 5. When the pumping device 13 is set in operation it draws in air via the housing 21—see the arrow L—as well as liquid from the rinsing chamber 214 and/or the contact element 22, feeding it to the first chamber 40 to build up there the necessary pressure for conveying liquid from the second chamber 41 via the second liquid conduit 32 to the rinsing chamber 214. By returning any surplus liquid from the rinsing chamber 214 and/or the contact element, which results from the suction cycle of the pumping device 13, it is possible to control the dispensing of liquid by the contact element 22 in such a way that liquid is dispensed to a skin to be wetted only when the contact surface of the contact element 22 is touched. Hence no liquid is dispensed when the contact element 22 is not being touched.

The gap 43 between the partition wall 42 and the second liquid conduit 32, which acts as a riser, is dimensioned so that the liquid delivered by the pumping device 13 into the first chamber 40 can penetrate the storage material 44 in the second chamber 41. Any reverse flow of liquid stored in the storage material from the second chamber 41 through the gap 43 into the first chamber 40 is prevented by the bonding effect of the liquid to the storage material 44.

Figure 8:
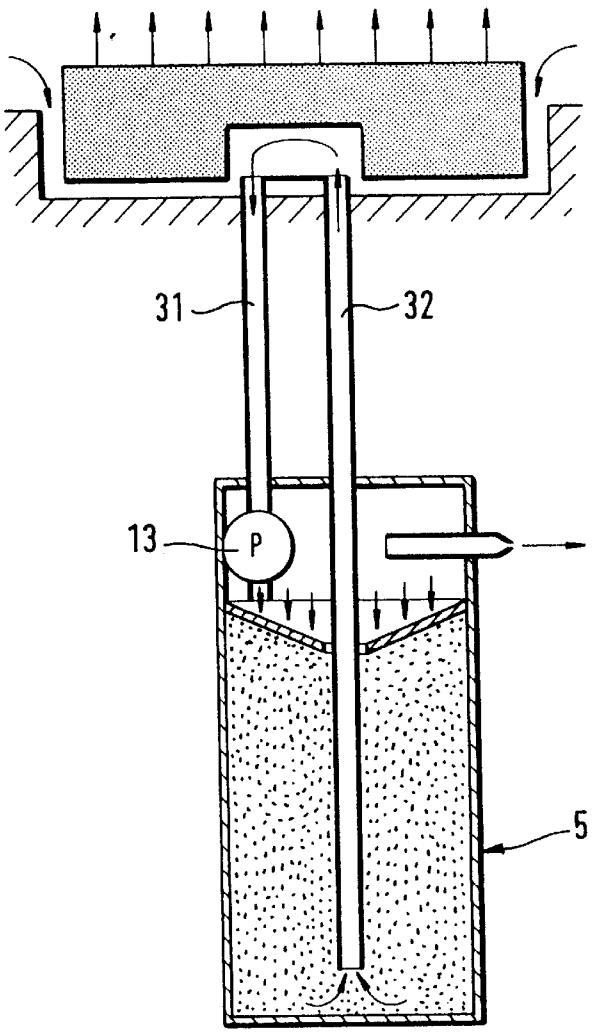
FIGS. 7 and 8 are schematic views of the liquid conveying arrangement comprised of a liquid container, a liquid dispensing device, a first and a second liquid conduit, and a pumping device.

FIG. 8 shows the liquid conveying arrangement of FIG. 7, the difference being that the pumping device 13 is disposed inside the liquid container 5, i.e., in the first chamber 40. The pumping device is part of the liquid container 5 and can be replaced together with it. The liquid container 5 can be replaced because the first liquid conduit 31 and the second liquid conduit 32 are coupled to the liquid container 5 by means of suitable coupling elements—not shown. Such coupling elements can also be provided in the first liquid conduit 31 and the second liquid conduit 32 of FIG. 7 in order to couple the pumping device 13 and the liquid container 5 to said conduits.

A suitably shaped rubber part, which tightly closes the complete unit, including the first and second liquid conduits 31, 32, is used as a cover for the liquid container 5. Metal tips of the first and second liquid conduits 31, 32, which are located inside the housing 1, pierce the cover in the area of the conduits when the cleaning liquid container is inserted, thus opening the liquid circuit.

The described configuration of the liquid container 5 is preferably implementable as a disposable cartridge or in the form of a container which can be filled in or on the hair removing apparatus.

Figure 9:
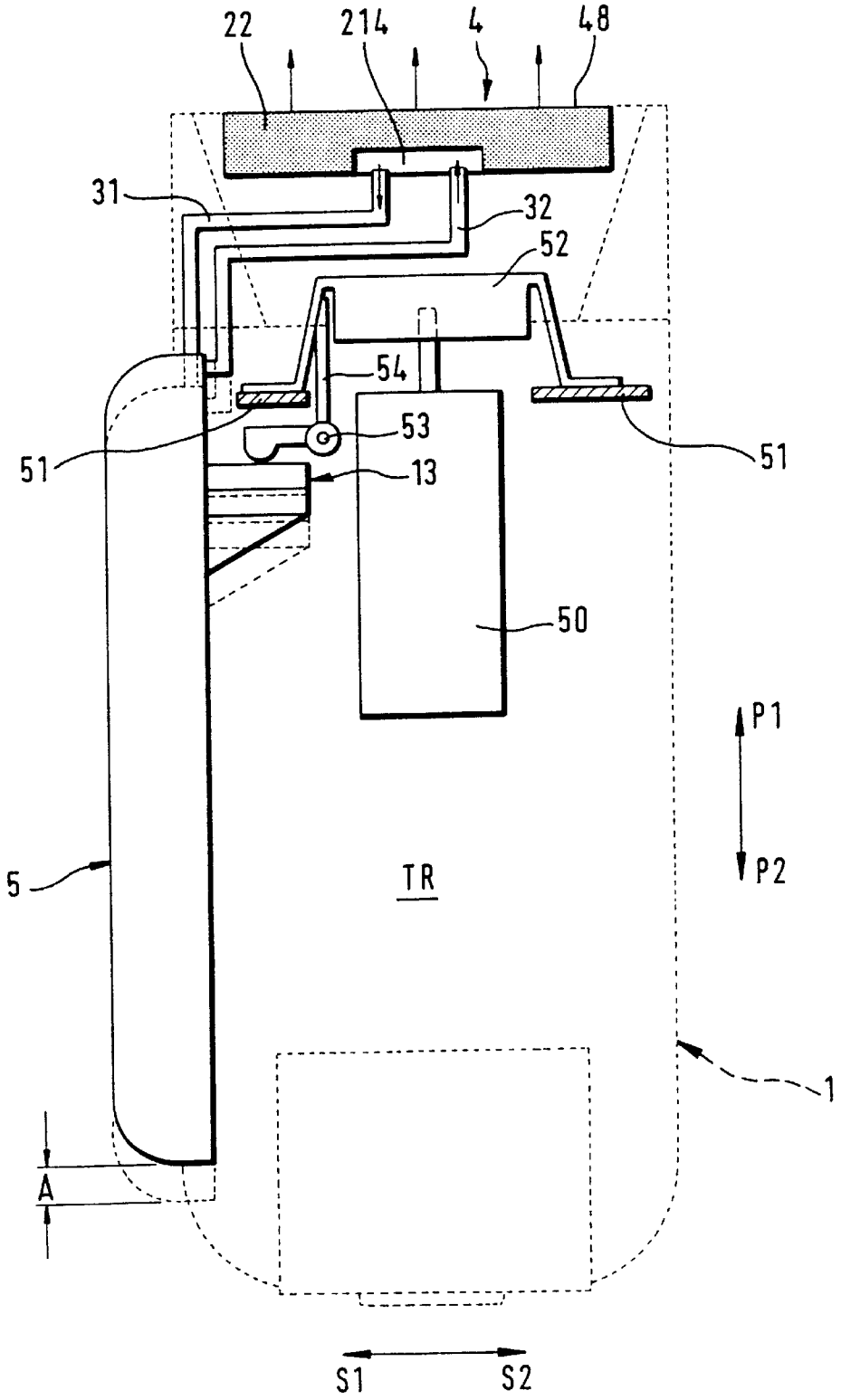
FIG. 9 is schematic view of the outer contours of a dry shaving apparatus with a drive mechanism for operating a shaving arrangement and a pumping device for feeding liquid from a liquid container into the liquid dispensing device.

FIG. 9 shows a schematic representation of the layout of a liquid conveying arrangement of FIG. 7 in a dry shaving apparatus TR of FIGS. 1 and 2. The contours of the dry shaving apparatus are represented by dotted lines by way of example.

In the housing 1 of the dry shaving apparatus TR there is arranged an electric motor 50 whose motor shaft is coupled by an eccentric to an oscillating member 52 in order to make it oscillate to and fro—see the directions of the arrows S1 and S2. The oscillating bridge 52 serves the function of driving cutter elements of the dry shaving apparatus TR—not illustrated—in addition to driving the pumping device 13 of the liquid dispensing device 4. For this purpose the oscillating member 52—which is fastened, for example, on wall elements 51 of the housing 1 of the dry shaving apparatus TR—is coupled by way of a double-armed oscillating lever 54, which is pivotally connected to a pivot 53 provided on the housing 1, to a pumping element of the pumping device 13 in order to transmit a driving motion. This driving connection is interruptible by sliding the liquid container 5 in the direction of the arrow P2 by a distance A so that no liquid is fed from the container 5 into the rinsing chamber 214 and the open-pore contact element 22. By sliding the liquid container 5 in the direction of the arrow P1 it is possible to re-establish the connection between the pumping element of the pumping device 13 and the double-armed lever 54 so that when the electric motor 50 is set in operation the oscillating movements of the oscillating member 52 are transmitted via the double-armed lever 54 to the pumping element of the pumping device 13, thus re-starting the liquid conveying arrangement.

The rinsing chamber 214 is coupled to the liquid container 5 via the pumping device 13 by means of a first liquid conduit 31—see FIG. 9—and to the first chamber 40 by means of a second liquid conduit 32. The first and second liquid conduits are of flexible construction in order to be able to follow the sliding movement of the liquid container 5 in the directions of the arrows P1 and P2.

Figure 10:
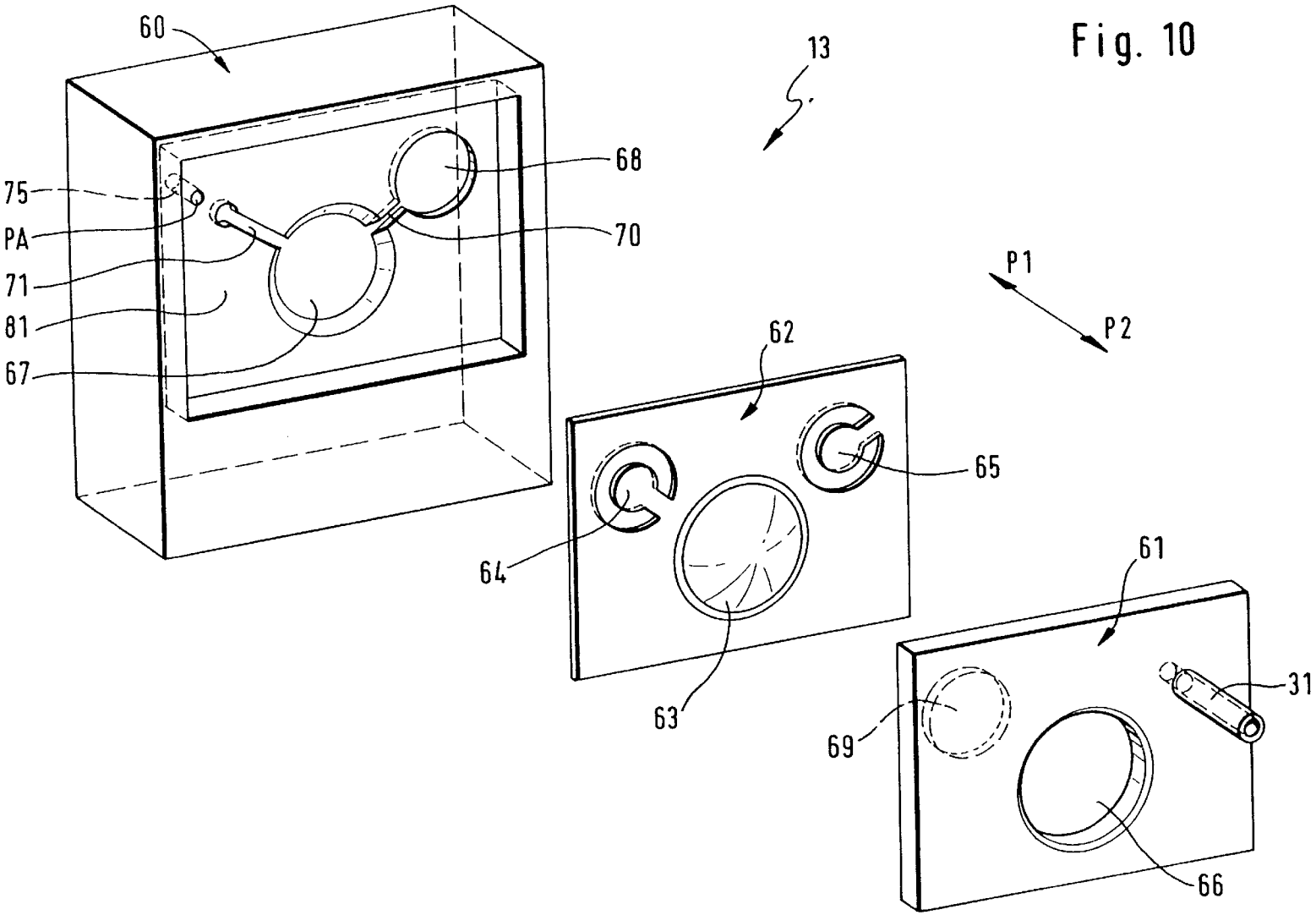
FIG. 10 is a view of a first and a second housing part and a membrane of a pumping device.

The components of a pumping device 13 are shown in FIG. 10. The pumping device 13 is comprised of only three parts, including a first housing part 60, a second housing part 61, and a membrane 62 which is disposed between the first housing part 60 and the second housing part 61. The membrane 62 has an elastic pumping element 63 projecting from the planar membrane wall in slightly domed form. Two flutter valves 64 and 65, which act as non-return valves, are provided in the wall of the membrane 62. The flutter valves 64 and 65 are elastically formed in the membrane wall and are a part of the membrane 62. The second housing part 61 is equipped with an opening 66 through which the pumping element 63 can be actuated by a drive element, e.g., by one arm of the double-armed lever 54 of FIG. 9. A first liquid conduit 31 is connectable to the second housing part 61. In the first housing part 60 is a pump chamber 67 which is connectable by way of a flow channel 70 to a first valve chamber 68 and by way of a further flow channel 71 to the second valve chamber 69 provided in the second housing part 61. The second valve chamber 69 is adapted to be coupled by way of an outlet PA and a pump outlet conduit 75 to a liquid conduit 47 leading to the first chamber 40 of the liquid container 5—see FIG. 7. The flutter valve 65 provided in the membrane 62 is associated on the one hand with the first liquid conduit 31 and on the other hand with the first valve chamber 68. The flutter valve 64 is associated with the second valve chamber 69 and with the liquid conduit 47 leading out of said chamber. Exerting a reciprocating pumping movement on the pumping element 63 causes the pumping element 63 to draw in and pump out liquid and/or air in alternation. During the pumping cycle the pumping element 63 is urged into the pump chamber 67 in the direction of the arrow P1. As this occurs, the liquid and/or air present in the pump chamber 67 is urged via the flow channel 71 against the flutter valve 64, moving the elastic flutter valve 64 into the second valve chamber 69, thereby clearing the flow path for the liquid and/or air via the second valve chamber 69 into the pump outlet conduit 75. The liquid and/or air subsequently flows via a connectable liquid conduit 47 into the first chamber 40 of the liquid container. During this pumping cycle the air and/or liquid exposed to the pumping pressure acts via the flow channel 70 and the first valve chamber 68 against the flutter valve 65, closing the pump inlet opening in the second housing part 61 which is adapted to be coupled with the first liquid conduit 31.

On termination of the pumping cycle the tensioned elastic pumping element 63 moves in the direction of the arrow P2 back to its initial position, thereby drawing in air and/or liquid from the first liquid conduit 31. This suction cycle causes the flutter valve 65 to move into the first valve chamber 68, thus clearing the liquid conduit 31 and enabling the air and/or liquid to flow via the first valve chamber and the flow channel 70 into the pump chamber 67. The flutter valve 64 is constructed and arranged relative to the flow channel 71 so that during the suction cycle the flow channel 70 is covered to such an extent that no air and/or liquid is allowed to flow past the flutter valve 64 into the second valve chamber 69 nor from there into the opening, not covered by the flutter valve 64, of the outlet PA and the pump outlet conduit 75.

The pumping device 13 represented in FIG. 10 may be arranged either outside or inside a liquid container 5, as is shown in FIGS. 7 and 8.

Figure 11:
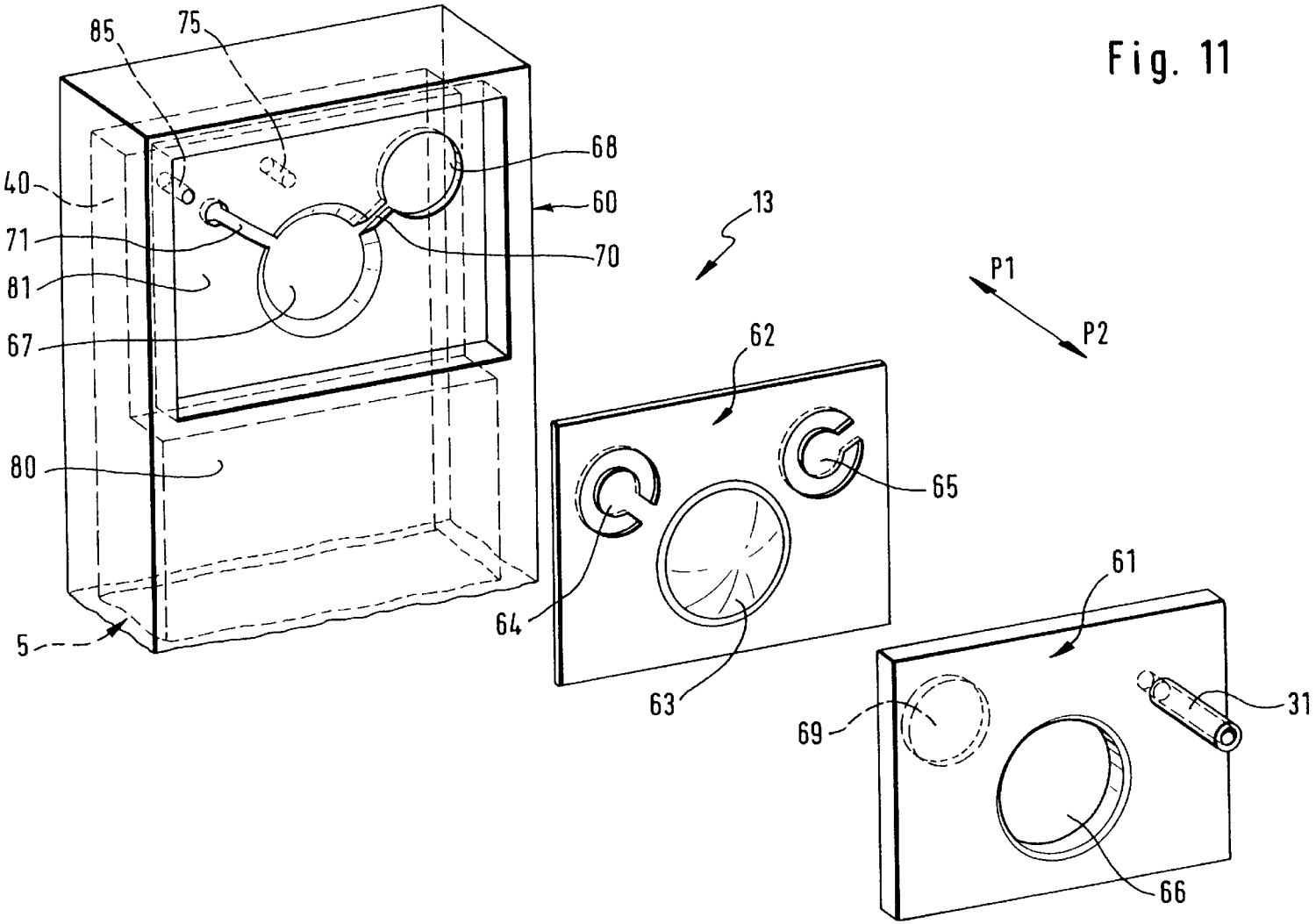
FIG. 11 is a view illustrating the integration of a pumping device into the housing of a liquid container.

According to a further embodiment the pumping device 13 may also be configured as part of the liquid container 5, as is shown in FIG. 11 by way of example.

The pumping device of FIG. 11 differs from the pumping device of FIG. 10 only inasmuch as the first housing part 60 of the pumping device 13 is part of a wall of the liquid container 5. In FIG. 11 part of the interior of a liquid container 5, namely the first chamber 40, is represented by broken lines. The chamber 40 is connectable by way of a pump outlet conduit 75 to the second liquid conduit—see FIG. 7. In the front 80 of the liquid container 5 provision is made for a depression 81 accommodating the first valve chamber 68, the flow channel 70, the pump chamber 67, the flow channel 71, and a liquid conduit 85 connecting the second valve chamber 69 to the first chamber 40 of the liquid container 5. The membrane 62 is embedded in the depression 81 and, using the second housing part 61 and suitable fastening elements, the previously listed components are assembled to form a complete pumping device 13 and then put into operation.

The liquid container 5 is inserted in the housing 1 of the hair removing apparatus and the sealing part pierced in the areas of the conduits, thus establishing a connection to the liquid conveying arrangement of the apparatus 1. Inserting the liquid container 5 simultaneously positions the pumping device 13 in front of the oscillating member 54 located in the housing 1. When the application function is activated the pumping device 13 begins to build up pressure in the liquid container 5. The air drawn in during the starting cycle is pumped into the first chamber 40 and can pass through the outlet gap 43 between the second liquid conduit 32 and the partition wall 42 into the second chamber 41 where it exerts pressure on the liquid. At the same time the suction cycle of the pumping device 13 produces a suction effect in the second liquid conduit 32 of the liquid circuit, which draws the liquid into the liquid dispensing device 4. The application point in the liquid dispensing device 4 is designed so that the pumping device 13 can draw in air from the outside at the same time as drawing in the non-applied liquid. Hence after the starting cycle the pumping device 13 invariably feeds a mixture of liquid and air into the liquid container 5, where the mixture is separated into its two components. This separation occurs on the inner wall of the first chamber 40 as the result of the adhesive force of the droplets. As the drops grow bigger they flow back through the outlet gap 43 into the second chamber 41 and so are returned to the liquid circuit.

Because this arrangement permanently draws in air in addition to the non-consumed liquid, the pressure built up in the first chamber 40 is higher than that which escapes with the liquid. This overpressure in the first chamber 40 prevents the liquid flowing back from the second chamber 41 into the first chamber 40. The pressure is stabilized by a defined opening in the air discharge throttle which acts as a pressure relief valve. Arranging the air discharge throttle in the upper area of the first partitioned chamber 40 prevents the inflowing droplets being blown out unintentionally when the hair removing apparatus is in an inclined position. Operation of the arrangement is thus guaranteed even with the hair removing apparatus turned through 180° compared to the position illustrated in FIG. 1.

The porous storage material ensures operational reliability also in cases when the liquid container 5 is not full. In this case the liquid reaches the suction zone of the second liquid conduit 32 through the capillary action of the storage material. Liquid movements and attendant noise are also minimized.

On account of the described structural design it is possible to store and dispense liquids independently of position and movement, with the arrangement simultaneously providing for regulation of the quantity of liquid to be dispensed.

What is claimed is:

1. A pumping device for drawing in and delivering a liquid to a liquid dispensing device of a hair removing apparatus the pumping device comprising a pump inlet, a pump outlet, and a pumping element, wherein said pumping device is formed by a first and a second housing part each having a valve chamber, the second housing part having integrally formed therein a first and a second flow channel, the pumping device having a membrane member disposed between the first and the second housing part, the membrane member including a pumping element and at least one valve element, and wherein the pump inlet is adapted to be coupled to the liquid dispensing device and the pump outlet to a liquid container.

2. The pumping device of claim 1, wherein the pumping device is provided outside the liquid container.

3. The pumping device of claim 1, wherein the pumping device is provided inside the liquid container.

4. The pumping device of claim 1, wherein one wall of the liquid container is constructed as the first housing part of the pumping device.

5. The pumping device of claim 1, wherein the membrane member is of elastic construction.

6. The pumping device of claim 1, wherein the valve element and the pumping element are of elastic construction and provided as part of the membrane member.

7. The pumping device of claim 1, wherein a flow path leading from the pump inlet to the pump outlet is formed by a pump chamber and the valve chamber of the first housing part as well as the valve chamber of the second housing part.

8. The pumping device of claim 1, wherein the pumping device with the liquid container is arranged to be replaceable.

9. The pumping device of claim 1, wherein the pumping device is designed to draw in and deliver at least one of a gaseous and a liquid medium and to build up a delivery pressure for the liquid held in the liquid container.

10. A hair removing apparatus comprising:

a housing;

a liquid dispenser connected to the housing; and a pumping device for delivering a liquid to the liquid dispenser, the pumping device comprising a first housing part, and a membrane between the first housing part and a second housing part, the membrane including a valve and a flexible diaphragm, at least one of the first and second housing parts defining an aperture exposing the flexible diaphragm;

wherein the pumping device is coupled to a liquid container arranged in or on the housing.

11. The hair removing apparatus of claim 10, wherein the aperture provides a drive element access to the flexible diaphragm for actuation of the flexible diaphragm.

12. The hair removing apparatus of claim 10, wherein the first and second housing parts each include a valve chamber.

13. The hair removing apparatus of claim 10 further including a pump inlet connected to the liquid dispenser.

14. The hair removing apparatus of claim 10 further including a pump outlet connected to the liquid container.

15. The hair removing apparatus of claim 10, wherein the pumping device is provided outside the liquid container.

16. The hair removing apparatus of claim 10, wherein the pumping device is provided inside the liquid container.

17. The hair removing apparatus of claim 10, wherein one wall of the liquid container is constructed as the first housing part of the pumping device.

18. The hair removing apparatus of claim 10, wherein the pumping device with the liquid container is arranged to be replaceable.

19. The hair removing apparatus of claim 10, wherein the pumping device is designed to draw in and deliver at least one of a gaseous and a liquid medium and to build up a delivery pressure for the liquid held in the liquid container.

20. The hair removing apparatus of claim 10, wherein at least one of the first and second housing parts include first and second flow channels.

21. The pumping device of claim 10, wherein the membrane is of elastic construction.

* * * * *